United States Patent [19]

Zegers et al.

[11] Patent Number: 4,758,271

[45] Date of Patent: Jul. 19, 1988

[54] CONTINUOUS COPPER DROSSING OF LEAD

[75] Inventors: Theodoor W. Zegers, Evergreen, Colo.; Philip M. Howard, Uxbridge; Georgi Angelov, Don Mills, both of Canada

[73] Assignee: AMAX Inc, Greenwich, Conn.

[21] Appl. No.: 928,429

[22] Filed: Nov. 10, 1986

[51] Int. Cl.[4] ..... C22B 13/06

[52] U.S. Cl. ..... 75/78; 266/205

[58] Field of Search ..... 75/78; 266/205

[56] References Cited

U.S. PATENT DOCUMENTS 3,392,011 7/1968 Krysko ..... 75/78

*Primary Examiner*—Peter D. Rosenberg

*Attorney, Agent, or Firm*—Michael A. Ciomek; Eugene J. Kalil

[57] ABSTRACT

A process for the continuous copper drossing of molten lead bullion is provided, the process comprising, establishing a column of molten lead having a hot top portion at a temperature of about 800° C. to 1150° C. and a bottom portion of substantially lower temperature of about 340° C. to 425° C. Approximately the middle portion of the molten lead is controlled at a temperature of about 750° C. to 900° C. to thereby provide a predetermined temperature gradient extending from the middle portion to the bottom portion controlled at about 340° C. to 425° C. The temperature of the top portion is controlled by induction heating and the temperature of the bottom portion by cooling coils containing a fluid coolant. The molten lead is fed continuously to the middle portion of the column while maintaining the temperature thereof at about 750° C. to 900° C. The molten lead is continuously withdrawn from the bottom portion of the column at a rate conducive to maintaining the desired predetermined temperature gradient between the middle of the container and the bottom thereof.

10 Claims, 2 Drawing Sheets

CONTINUOUS COPPER DROSSING OF LEAD

The present invention relates to the pyrometallurgical refining of lead and, more particularly, to the continuous drossing of lead.

BACKGROUND AND PRIOR ART

Lead bullion is usually produced by smelting in a blast furnace and, depending upon the type of ore being treated, it generally contains signficant amounts of impurities, such as copper, iron, zinc and arsenic. In order to produce marketable lead, the molten lead is subjected to a series of refining operations. The aforementioned impurities have traditionally been removed from molten lead by a drossing operation.

The drossing operation comprises cooling molten lead from a temperature of about 800° C. to a temperature above the melting point of lead. As the molten lead cools, the solubility of the elements or compounds thereof (e.g., copper sulfide) decreases as the temperature falls, and the elements or compounds are rejected from the solution. The rejected elements or compounds float to the surface of the lead either as solids or as liquids which are skimmed or otherwise removed from the top portion of the molten lead to provide a refined lead product.

The presence of sulfur reduces the solubility of copper in lead. Thus the amount of copper remaining in the bullion after the treatment described hereinabove, can be further reduced by treatment with sulfur as the seed material.

Drossing has generally been accomplished by pouring large quantities of molten lead into a kettle or pot which allows for the formation of lead oxide fumes and lead oxide dross. A disadvantage of this process is the loss of lead due to oxidation and the production of lead fumes which, if not controlled, contribute to hazardous working conditions. A further disadvantage of this type of drossing operation is the significant labor required to skim the dross from the kettle, as well as exposure of the workforce to potentially toxic conditions, such as to lead poisoning.

The prior art is replete with proposed solutions to the problem of the drossing of lead. For example, in U.S. Pat. No. 3,317,311, a process is provided for the copper drossing of lead bullion whereby molten lead is fed to a vessel in which an upper portion is maintained at a high enough temperature to prevent any accretions from forming on the inside of its walls, and a lower portion which is drastically cooled to form accretion banks consisting of a matrix of solid lead containing precipitated particles of impurities, such as copper, or copper sulfides and arsenides. Relatively cold drossed lead is drawn from the bottom of the vessel, and from time to time the cooling is interrupted to melt off the accretion banks to cause copper-containing particles to float to the top of the molten lead in the vessel and dissolve in a matte layer, the molten matte being thereafter tapped at intervals. The drastic cooling referred to is effected by the direct spraying of water upon the outer surface of the lower portion of the vessel.

As will be apparent, this process is semi-continuous in that the drossing operation must be periodically terminated to remove lead deposits from the sidewalls of the vessel.

Another approach to the problem is disclosed in U.S. Pat. No. 3,260,592. According to the patent, copper is separated from lead bullion by using a process comprising continuously mixing bullion at a relatively high temperature with recirculated bullion having a lower temperature and a lower copper content whereby the mixture has an intermediate temperature to effect the separation of copper dross therefrom. The mixture is cooled and a proportion of it recirculated for admixture with additional hot bullion, the balance of the cooled mixture being discharged from the operation.

The hot bullion in the aforementioned process preferably flows downwardly from the upper zone of the bath and continues to flow downwardly after admixture with the cooler bullion, while the dross particles which separate from the mixture rise to the top and float on the free surface. The surface of the bath is maintained at a temperature above the melting point of the dross, whereby the molten dross is caused to flow through a suitably positioned discharge opening which eliminates the necessity of manually skimming the dross.

By cooling the hot bullion by admixture with the circulated cooler bullion, the dross separates out within the body of the mixture, thereby substantially avoiding the formation of the solid accretions on the walls of the containing furnace, kettle, or the like. The process described by the patent requires the recirculation of large amounts of lead to effect the desired cooling substantially in excess of the amount discharged. A disadvantage of this process is that a large inventory of lead for recirculation is required. In addition, the process is energy intensive.

OBJECTS OF THE INVENTION

It is thus an object of the invention to provide a continuous process for the copper drossing of lead bullion.

Another object of the invention is to provide a continuous process for drossing lead while minimizing the formation of accretions on the walls of the vessel containing said lead bullion.

These and other objects will more clearly appear when taken in conjunction with the following disclosure, the claims and the accompanying drawings, wherein:

STATEMENT OF THE INVENTION

Figure 1:
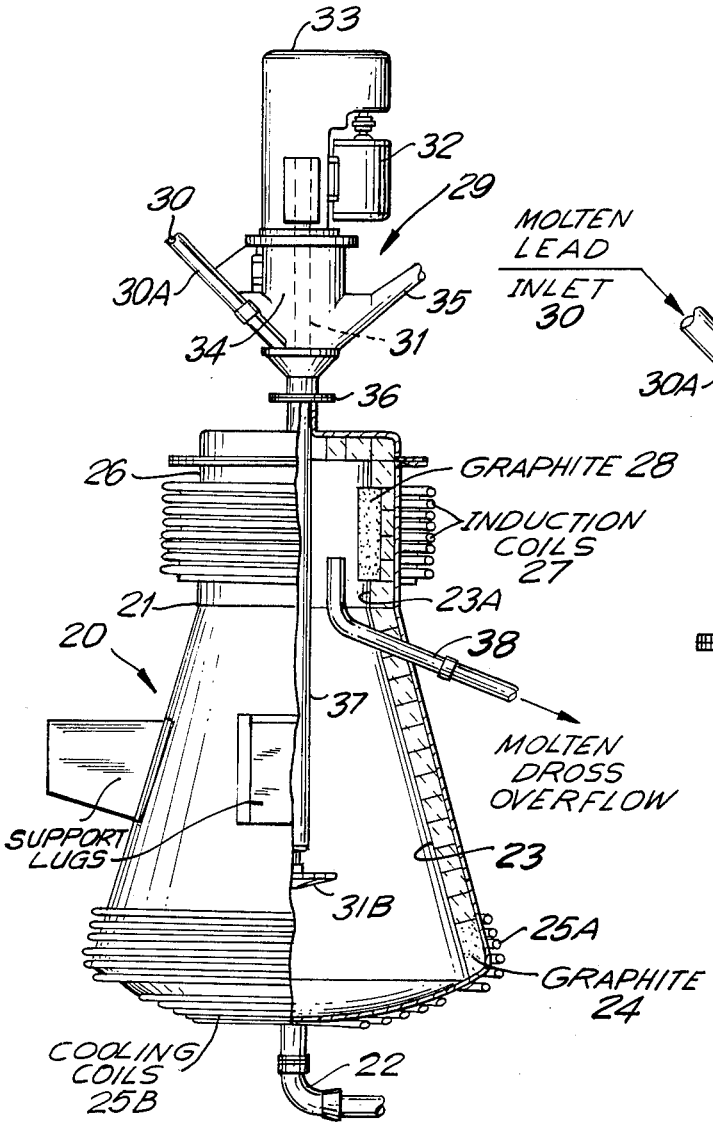
FIG. 1 is one embodiment of an apparatus for carrying out the invention.

One embodiment of the invention is directed to a process for the continuous copper drossing of molten lead comprising establishing a column of molten lead having a hot top portion and a bottom portion of substantially lower temperature such as to provide a predetermined temperature gradient extending from the top portion to the bottom portion. The temperature of the top portion is preferably at least about 800° C. and ranges up to about 1150° C., the temperature of the bottom portion being at least about 340° C. and ranges up to about 425° C. The invention further comprises maintaining the matte in a molten state (i.e., the metal sulfide which separates from the molten lead) by induction heating and the temperature of the bottom portion by cooling coils containing a circulating fluid, e.g., water. The molten lead is continuously fed to approximately the middle of the column where the temperature thereof is at about 750° C. to 900° C.

The molten lead is continuously withdrawn from the bottom portion of the column at a rate to maintain the desired predetermined level of the molten lead in the column, the residence time in the column at said rate of withdrawal being sufficient to allow copper and other contaminants (for example, matte) to precipitate from the lead at substantially said bottom portion and rise to and collect at the top portion from where the contaminants are continuously withdrawn. Thus, as the molten lead traverses the temperature gradient from approximately the middle of the column to the bottom thereof, such impurities as copper sulfide, iron sulfide and arsenides are rejected from solution and rise to the top of the column.

The temperature at the top portion of the column is preferably controlled at about 875° C. to 1100° C. and, more preferably, at about 900° C. to 1000° C.

The temperature at the bottom portion is preferably controlled at about 340° C. to 425° C. and more preferably, from about 350° C. to 400° C.

To promote the rejection of copper and other contaminants, seed material selective to the precipitation of copper may be added. Sulfur is particularly preferred for copper and iron precipitation.

DETAILS OF THE INVENTION

Molten lead obtained by smelting lead sinter in a blast furnace or obtained by direct smelting of lead sulfide concentrates can contain up to about 3% copper, up to about 2% sulfur, up to about 1% iron, up to about 1.5% arsenic, up to about 2% bismuth and up to about 2% antimony. Usually lead obtained from smelting operations contains between about 1% and about 2.5% copper, between about 0.3% and about 1% sulfur, between about 0.5% and about 0.8% iron, between about 0.7% and about 1% arsenic, and between about 1% and about 1.5% antimony. The molten lead usually leaves the smelting operation at a temperature between about 850° C. and about 1100° C. and most generally, between about 900° C. and about 1000° C.

In accordance with the process of the present invention, molten lead from a smelting operation is fed to a vertically disposed chamber to establish a column of molten lead, with the molten dross (e.g., matte) floating on top. The molten matte floating on top of the molten lead is maintained at a temperature between about 850° C. and about 1050° C., advantageously at a temperature between about 900° C. and about 1000° C., by induction heating. The top and sides of the vertically disposed chamber are insulated to minimize heat losses and the upper part is surrounded by induction coils which are operated at a frequency to minimize agitation of the molten lead in the upper portion of the column. The temperature at which the matte is maintained is selected to allow continuous or semicontinuous withdrawal of dross (matte) from the top of the column.

Water-cooled coils are attached to the bottom of the furnace to withdraw sufficient heat from the molten lead to maintain a desired temperature gradient. Molten lead from a smelting operation is fed to approximately the middle of the column in a manner to minimize mixing and at a rate substantially equal to the rate at which molten lead is withdrawn from the bottom of the column. Refined molten lead is withdrawn from the bottom of the column at a temperature below about 450° C., e.g., between about 340° C. and about 425° C., and advantageously at a temperature between about 350° C. and about 400° C. The rate at which molten lead from smelting operations is fed to substantially the middle of the column and the rate at which refined lead is withdrawn from the bottom of the column are selected to insure that the refined lead withdrawn from the bottom of the column is preferably at a temperature between about 340° C. and about 400° C. The lower portion of the vertically disposed chamber can be equipped with an additional set of induction coils as an optional feature for melting any metallic lead and/or sulfide deposited as accretions on the walls of the lower portion of the column.

Figure 3:
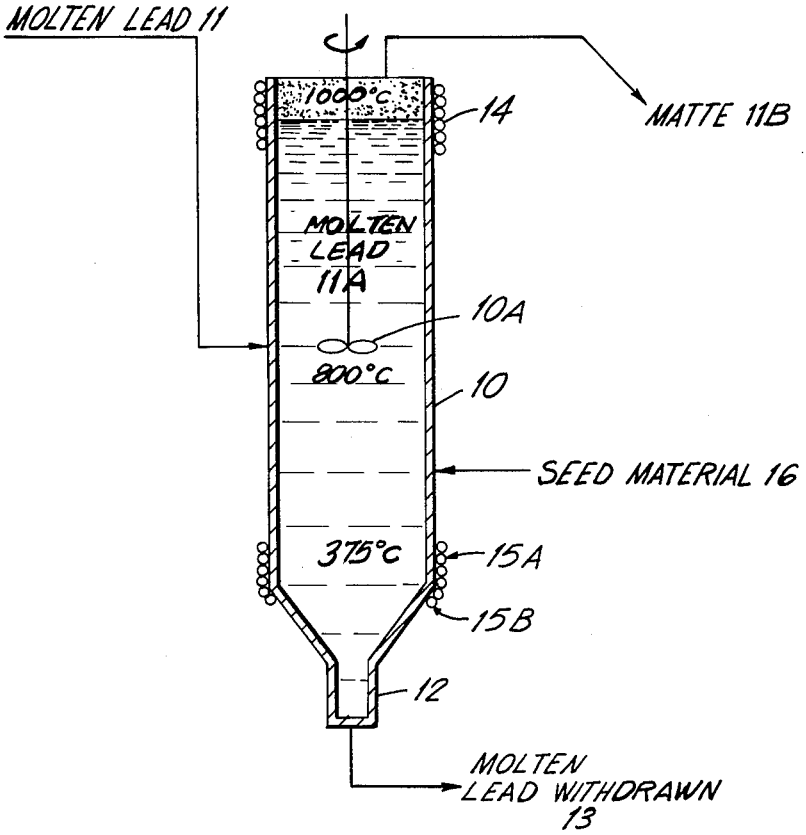
FIG. 3 is a schematic illustrating one embodiment of the invention.

Referring first to the schematic of FIG. 3, a vertically disposed column 10 of molten lead 11A is disclosed showing molten lead 11 being fed to approximately the middle of the column near the impeller 10A and purified lead 13 being withdrawn from the lower portion of the column at 12.

The temperature of the matte 11B floating on the top of the molten lead is controlled at about 1000° C. via induction heating coils 14 to maintain it in the molten state. The lower portion is controlled at the temperature of about 375° C. via cooling coils 15B to provide a predetermined temperature gradient extending from about the middle of the column to the bottom thereof. Heating coils 15A may be provided near the cooling coils for the subsequent melting of accretions which may form at or near the bottom portion of the column.

By maintaining the desired temperature gradient, the contaminants or impurities are rejected during cooling while minimizing the formation of solid accretions at the bottom portion of the column. To promote the rejection or precipitation of impurities, seed material 16, e.g., sulfur, may be injected into the column of molten lead as shown. In carrying out the purification of lead, gentle stirring of the molten bath at approximately the middle of the column is preferred.

Figure 2:
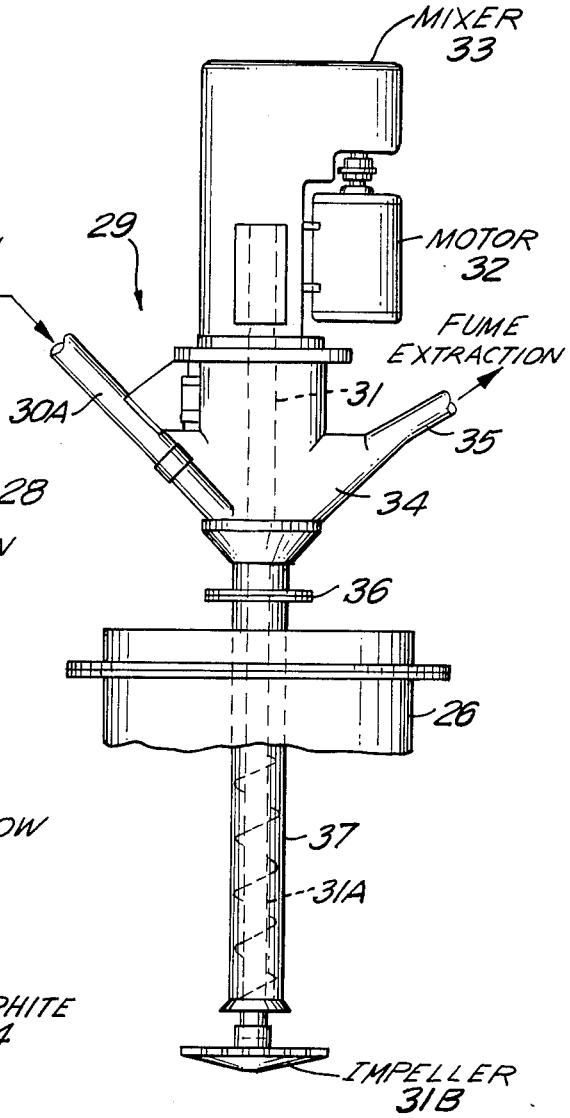
FIG. 2 is a more detailed view in elevation of one embodiment of a stirring device used with the apparatus of FIG. 1.

FIGS. 1 and 2 are illustrative of one embodiment of the apparatus that can be used in carrying out the process of the invention.

Referring to FIG. 1, a container or kettle 20 is depicted which flares conically outward from a neck 21 to the outlet 22. The container sidewalls are lined with refractory 23 as shown, the lower portion adjacent the bottom being lined with graphite 24 to provide good heat conductivity by inductive coupling with coils 25A used for melting any accretions that form during purification of the lead. Cooling coils 25B are provided at the bottom for controlling the temperature of the lead to be removed and for providing the desired temperature gradient.

The upper portion 26 of neck 21 of the container is surrounded by induction heating coils 27 and an inner refractory wall 23A having an annular graphite insert 28 for inductive coupling with heating coils 27 so as to assure good heat conductivity for maintaining the matte molten.

Heating by induction is well known to those skilled in the art and need not be described, the technology of such heating being readily available from manufacturers of induction heating equipment.

A stirring device 29 (FIGS. 1 and 2) may be employed, the device being constructed so as to aid in the delivery of molten lead via molten lead inlet 30, the stirrer comprising a shaft 31 actuated by motor 32 of mixer 33, the upper portion of shaft 31 being surrounded by a housing 34 to which molten lead inlet 30 and channel 30A are coupled, the other side of the housing having an exit port 35 for fume extraction.

The housing (FIG. 2) is coupled to the top of container 20 via coupling 36, the shaft passing through a hollow elongated cylinder 37 of alloy steel, the lower part of the shaft 31A being helically configurated and being formed of alloy steel, to provide a screw conveyor for the molten lead to direct the lead toward impeller 31B, whereby the molten lead is distributed to approximately the middle portion of the container. The residence time is determined by the rate of withdrawal, the residence time being chosen by tests to provide a steady state having the desired temperature gradient extending from the hot middle portion to the lower colder portion conducive to the rejection of impurities which rise to the top and are removed via molten matte overflow 38 shown in FIG. 1.

By employing the method of cooling in accordance with the present invention wherein the temperature at the bottom of the column of lead is controlled over the temperature range stated, the amount of lead and dross accreted on the side walls of the vertically disposed chamber is substantially minimized and only infrequently must the drossing operation be terminated to allow such accretions to be removed by heating (note heating coils 25A). Thus, the process in accordance with the present invention is truly continuous. Moreover, the use of induction heating in the upper portion of the vertically disposed chamber makes the process more energy efficient and more environmentally acceptable. Induction heating by its very nature insures that the matte is heated directly through the inductive coupling of graphite ring 28. Thus, more precise control can be obtained by the use of induction heating. Environmental problems are minimized because the atmosphere above the dross phase can be controlled and large volumes of combustion gases are not generated which combustion gases and uneven temperature control aggravate the fuming problem.

As stated herein, it may be desirable to feed seed material to the lower portion of the lead column to promote the rejection of impurities from the molten lead and to facilitate the transport of the impurities to the dross phase. As the purity of the lead increases as it travels down the temperature gradient via gentle stirring and as nucleation of the impurities becomes more difficult, the introduction of a seed material obviates the need to overcome the nucleation energy barrier and insures that the rejected impurities form larger masses which rise more rapidly through the molten lead column. Advantageously, the seed material is introduced into the molten lead at a temperature equal to or less than the temperature of molten lead at the point of introduction thereby facilitating cooling. Examples of seed material are sulfur, copper sulfide, granulated dross, or other sulfides.

In summary, the apparatus for carrying out the invention comprises a vertically-disposed container. The container has associated with it a stirring assembly comprising a housing mounted to the top of the container including a rotatable shaft extending coaxially into the container, the shaft having an impeller at the end thereof located near the middle of the container.

The stirrer assembly housing has means (e.g., a motor) for rotating the shaft, including inlet means for feeding molten lead to the container and an exit portion for removing fumes from the container. The shaft is surrounded by an elongated hollow cylinder or pipe through which the molten lead is fed into the container, the shaft extending into the container with the pipe being helically configurated to provide screw feeding of the molten lead as it flows through the pipe.

The top portion of the container is surrounded by induction heating means to maintain the matte in the molten state and the bottom portion by cooling coils to achieve the desired temperature gradient in the vertically disposed column of molten lead. The purified lead is then removed through an exit port at the bottom of the container.

Although the present invention has been described in conjunction with the preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A process for the continuous copper drossing of molten lead bullion which comprises:

establishing a column of molten lead having a hot top portion in which the lead is heated to a temperature of about 800° C. to 1150° C. and a bottom portion in which the lead is maintained at substantially a lower temperature such as to provide a predetermined temperatue gradient controlled from approximately the middle of said column and extending to the bottom portion thereon, the temperature at approximately the middle of said column ranging from about 750° C. to 900° C., the temperature at the bottom of said molten lead ranging from about 340° C. to about 425° C., said temperature being controlled by cooling means maintaining the temperature of the middle portion of said column and at the bottom portion thereof over the aforementioned temperature ranges, respectively, to thereby provide a controlled temperature gradient therebetween, continuously feeding molten lead to approximately the middle of said column through a hollow elongated cylinder axially disposed in said column while maintaining the temperature thereof at about 750° C. to 900° C. and while stirring said molten lead as it enters the column, continuously withdrawing molten lead from the bottom portion of said column at a rate to maintain said predetermined temperature gradient, the residence time at said rate of withdrawal being sufficient to allow copper and other contaminants as dross to precipitate from the lead at substantially said bottom portion and rise to and collect at said top portion, and continuously removing said contaminants from said top portion.

2. The process of claim 1, wherein the precipiation of at least copper is promoted by adding seed material selective to the precipitation of copper.

3. The process of claim 2, wherein said seed material is selected from the group consisting of sulfur, copper sulfide and granulated dross.

4. The process of claim 3, wherein said seed material is sulfur.

5. The process of claim 4, wherein said seed material is copper sulfide.

6. An apparatus for purifying molten lead which comprises, a vertically-disposed container for supporting a column of molten lead, a stirring assembly having a housing mounted to the top portion of the container including a shaft extending coaxially into said container and having an impeller coupled to the end thereof located at approximately the middle of said container, said housing having means for rotating said shaft, including inlet means for feeding molten lead to approximately the middle of said container and an exit port for removing fumes from said container, an elongated hollow cylinder for receiving molten lead forming a part of said stirring assembly surrounding said shaft and extending to approximately the middle of said container to the impeller of said shaft, the portion of the shaft extending into said container being helically configurated to provide screw feeding of said molten lead flowing through said hollow cylinder into the container, induction heating means surrounding the top portion of said container, cooling coil means surrounding the bottom portion of said container, and an exit port at the bottom of said container for removing purified molten lead therefrom.

7. A process for the continuous copper drossing of molten lead bullion which comprises:

establishing a column of molten lead having a hot top portion in which the lead is heated to a temperature of about 800° C. to 1150° C. in which the lead is maintained at substantially a lower temperature such as to provide a predetermined temperature gradient controlled approximately the middle of said column from and extending to the bottom portion thereof, the temperatue at approximately the middle of said column ranging from about 750° C. to 900° C., the temperature of the bottom of said molten lead ranging from about 340° C. to about 425° C., said temperature being controlled by cooling means, maintaining the temperature of the middle portion of said column and at the bottom portion thereof over the aforementioned temperatue ranges, respectively, to thereby provide a controlled temperature gradient therebetween, continuously feeding molten lead to approximately the middle of said column through a hollow elongated cylinder axially disposed in said column while maintaining the temperature thereof at about 750° C. to 900° C. and while stirring said molten lead as it enters the column, injecting seed material into said column of lead selective to and to promote the precipitation of copper therefrom;

continuously withdrawing molten lead from the bottom portion of said column at a rate to maintain said predetermined temperature gradient, the residence time at said rate of withdrawal following injection of said seed material being sufficient to allow copper and other contaminants as dross to precipitate from the lead at substantially said bottom portion and rise to and collect at said top portion, and continuously removing said precipitated copper and said contaminants from said top portion.

8. The process of claim 7, wherein said seed material is selected from the group consisting of sulfur, copper sulfide and granulated dross.

9. The process of claim 8, wherein said seed material is sulfur.

10. The process of claim 9, wherein said seed material is copper sulfide.

* * * * *